US008329630B2

(12) United States Patent
Finison et al.

(10) Patent No.: US 8,329,630 B2
(45) Date of Patent: Dec. 11, 2012

(54) READY TO USE THICKENED DEGREASER AND ASSOCIATED METHODS

(75) Inventors: Jeremy B. Finison, Pine Hall, NC (US); Daniel L. Moran, Greensboro, NC (US); Stephen T. Smith, Greensboro, NC (US); Thomas J. Vinson, Thomasville, NC (US); Karen O. Rigley, Greensboro, NC (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 13/358,658

(22) Filed: Jan. 26, 2012

(65) Prior Publication Data

US 2012/0165240 A1 Jun. 28, 2012

Related U.S. Application Data

(63) Continuation-in-part of application No. 12/874,693, filed on Sep. 2, 2010, which is a continuation-in-part of application No. 12/105,822, filed on Apr. 18, 2008, now Pat. No. 7,838,484.

(51) Int. Cl.
*C11D 1/94* (2006.01)
*C11D 3/30* (2006.01)

(52) U.S. Cl. ..... 510/197; 510/225; 510/233; 510/235; 510/245; 510/252; 510/365; 510/421; 510/422; 510/426; 510/427; 510/490; 510/509; 510/511

(58) Field of Classification Search ..... 510/197, 510/225, 233, 235, 245, 252, 365, 421, 422, 510/426, 427, 490, 509, 511
See application file for complete search history.

(56) References Cited

U.S. PATENT DOCUMENTS

| | | | | |
|---|---|---|---|---|
| 4,372,788 | A | 2/1983 | Lancz | 134/4 |
| 4,477,365 | A | 10/1984 | Verboom et al. | 252/156 |
| 4,676,920 | A * | 6/1987 | Culshaw | 510/396 |
| 4,877,691 | A | 10/1989 | Cockrell, Jr. | 428/688 |
| 5,364,551 | A * | 11/1994 | Lentsch et al. | 510/100 |
| 5,380,454 | A * | 1/1995 | Griepenburg et al. | 510/197 |
| 5,480,493 | A | 1/1996 | Harry, Jr. | 134/4 |
| 5,670,473 | A * | 9/1997 | Scepanski | 510/445 |
| 5,858,941 | A * | 1/1999 | Oakes et al. | 510/179 |
| 5,922,667 | A * | 7/1999 | van Baggem et al. | 510/403 |
| 6,784,148 | B2 | 8/2004 | Tadrowski et al. | 510/197 |
| 2003/0022804 | A1 * | 1/2003 | Tadrowski et al. | 510/218 |
| 2003/0176305 | A1 * | 9/2003 | Hoyt et al. | 510/245 |
| 2004/0067866 | A1 * | 4/2004 | Griese et al. | 510/407 |
| 2005/0079992 | A1 * | 4/2005 | Smith | 510/506 |
| 2006/0183656 | A1 * | 8/2006 | Bastigkeit et al. | 510/357 |
| 2008/0274930 | A1 * | 11/2008 | Smith et al. | 510/221 |

FOREIGN PATENT DOCUMENTS

| | | |
|---|---|---|
| EP | 0 479 888 B1 | 4/1992 |
| EP | 0 719 319 B1 | 7/1996 |
| EP | 0 919 612 B1 | 6/1999 |
| GB | 2 294 942 A | 5/1996 |

* cited by examiner

*Primary Examiner* — Charles Boyer
(74) *Attorney, Agent, or Firm* — Andrew D. Sorensen; Laura C. Dilorenzo; Amy J. Hoffman

(57) ABSTRACT

Cleaner compositions, methods of making cleaners, and methods of use are disclosed. Disclosed is a method of formulating a ready-to-use degreaser composition that has extended to infinite cling time. The method of making the cleaner results in thickened compositions that are capable of removing from vertical and inverted surfaces fresh, greasy and baked-on soils encountered in the food industry. The compositions include one or more alkalinity sources, one or more chelants, one or more surfactants, one or more thickening agents, one or more solvents, one or more buffers, and as a remainder, water. Compositions prepared according to the method of the invention are substantially free of phosphorous and have a low caustic content making them user friendly, having a lower pH than commercially available cleaners. Yet the cleaners prepared according to the method of the invention are surprisingly effective at removing tenacious baked-on soils encountered in the food service industry.

20 Claims, No Drawings

READY TO USE THICKENED DEGREASER AND ASSOCIATED METHODS

CROSS-REFERENCE TO RELATED APPLICATIONS

This application claims priority to U.S. patent application Ser. No. 12/874,693 filed on Sep. 2, 2010 and entitled, "THICKENED OVEN CLEANER, ASSOCIATED CLEANERS, AND ASSOCIATED METHODS" which claims priority to U.S. patent application Ser. No. 12/105,822 filed on Apr. 18, 2008 and entitled "CLEANER CONCENTRATE, ASSOCIATED CLEANERS, AND ASSOCIATED METHODS", the entire disclosures of which are incorporated herein by reference for all purposes.

FIELD OF THE INVENTION

Aspects of embodiments and embodiments of the present invention relate to methods of making cleaner compositions, associated cleaners, and associated methods for use in removing from surfaces fresh, greasy soils and baked-on soils commonly encountered in the food service industry. In particular, embodiments of the invention provide viscous or thickened cleaners useful in removing greasy and baked-on soils from vertical or inverted surfaces such as those found in appliances, for example.

BACKGROUND

Greasy soils are often encountered on surfaces (e.g., floors, hoods, appliances—both interior and exterior surfaces, counter tops, shelves, walls, ceilings, and the like) in the food service industry. One type of soil can be referred to as fresh, greasy soil, and the other type of soil can be referred to as baked-on soil. Fresh, greasy soils can result from the presence of fatty soil, which can comprise, for example, a neutral fatty acid triglyceride ester and similar neutral fats, and free fatty acids or salts thereof. The fatty acid salts can be formed from a cation such as sodium, calcium, magnesium, ferric, ferrous, and the like, or combinations thereof.

While existing cleaners may be somewhat effective at removing such soils from horizontal surfaces, they are less effective at removing soils from vertical or inverted surfaces such as found in the interior of ovens or hoods. This less effective cleaning is due in part to reduced contact time. That is, many oven and hood cleaners require a somewhat extended contact time in order to effectively remove the soils and grease from a surface. If the cleaner is applied to a vertical or inverted surface and does not adhere to the greasy or soiled surface for an effective amount of time to act on the grease or soil, it cannot effectively remove the grease or soil without the use of high pH cleaners or high vapor pressure solvents.

It would therefore be desirable to provide a cleaner composition, associated cleaners, and associated methods to address the different challenges presented by baked-on soils located on vertical and inverted surfaces encountered in the food service industry. A thickened cleaner composition and associated thickened cleaner that is substantially free of phosphorous and/or phosphates, includes high flash point solvent(s), includes low vapor pressure solvent(s), and has relatively low caustic content would be desirable. Additionally, such a cleaner composition that is also safe to use without gloves or masks, is safe to use on soft metal surfaces without the risk of discoloration or attack, has a relatively high flash point, and includes zero volatile organic compounds would be desirable.

SUMMARY

Aspects of embodiments and embodiments of the present invention meet these and other needs by providing, without limitation, a method of preparing cleaner compositions, associated cleaners, and associated methods for use in removing from vertical and inverted surfaces fresh, greasy or baked-on soils at about room temperature or at elevated temperatures. Advantageously, cleaner compositions prepared according to the method of the invention are formulated to be capable of use for removing soils from vertical and inverted surfaces. In aspects of embodiments, such soils originate from a fat and/or oil from the food service industry.

In aspects of embodiments of the present invention, the method provides cleaner compositions including one or more alkalinity sources, one or more chelants, one or more surfactants, one or more solvents, one or more thickening agents and, as a remainder, water. The one or more alkalinity sources may be present in an amount sufficient to provide a free alkalinity (expressed as weight percent $Na_2O$) of less than about 1.0 wt %, based on the total weight of the cleaner composition, and a total alkalinity (expressed as weight percent $Na_2O$) of less than about 2.0 wt %, based on the total weight of the cleaner composition. The one or more chelants may be present in an amount from about 0.05% to 2.0%. The one or more surfactants may be present in an amount from about 0.1 wt % to about 3.0 wt %, based on the total weight of the cleaner composition. The one or more solvents may be present in an amount from about 3.0 to about 8.0 wt %. The one or more thickening agent may be present in amount from about 0.1 wt % to about 2.0 wt %. An optional corrosion inhibitor may be present in an amount from about 0.01 to about 0.75 wt %. The remainder to 100 wt % may be water, based on the total weight of the cleaner composition.

In aspects of embodiments, cleaner compositions further include one or more buffers in an amount sufficient to substantially maintain a pH below 11.5. A buffering agent may be present in an amount from about 0.25 to about 1.0 wt %. In other aspects, cleaner compositions further include from about 0 wt % to about 1.5 wt % of one or more hydrotropes.

When used, one or more buffers may include a base and a complementary acid. Examples of a base include, without limitation, one or more of a borate (e.g., tetraborate, borax, and the like, or combinations thereof), bicarbonate (e.g., sodium bicarbonate, mixtures of sodium bicarbonate and sodium carbonate, and the like, or combinations thereof), carbonate (e.g., sodium carbonate), and the like, or combinations thereof. Examples of complementary acids include, without limitation, one or more of an alkali metal salt of an inorganic acid, alkali metal salt of an organic acid, or amine salt of an organic acid, such as, without limitation, sodium, potassium or alkanolamine salts of acetic acid, citric acid, lactic acid, tartaric acid, and the like, or combinations thereof. As to an amount of one or more buffers, in one aspect it may be about 0.01 wt % to about 5.0 wt %, based on the total weight of the cleaner composition. In another aspect, the one or more buffers may be about 0.01 wt % to about 4.0 wt %, based on the total weight of the cleaner composition. In yet another aspect, an amount of one or more buffers may be about 0.01 wt % to about 1.0 wt %, based on the total weight of the cleaner composition.

Without limitation, some examples of one or more hydrotropes that may be used include, one or more of xylenesulfonic acid, sodium salt; toluenesulfonic acid, sodium salt; xylenesulfonic acid, ammonium salt; cumenesulfonic acid, sodium salt; cumenesulfonic acid, ammonium salt; xylenesulfonic acid, calcium salt; xylenesulfonic acid, potassium salt; toluenesulfonic acid, potassium salt; glycol; glycol ether; monoproprionate; diproprionate; and the like, or combinations thereof Thickeners particularly useful in formulating compositions of the invention are polycarboxylic acids. Compositions of the invention are applied via a foaming sprayer, for example. Ready to use solutions of the invention have a viscosity of greater than about 300 centipoise (cps), greater than about 400 cps, greater than about 500 cps, greater than about 600 cps and greater than about 650 cps. This enhanced viscosity provides a longer cling time allowing the solution to contact a vertical or inverted surface for sufficient time to remove fresh, greasy and/or baked-on soils. Compositions prepared according to the method of the invention surprisingly have extended cling times. In embodiments of the invention compositions prepared according to the method of the invention exhibit infinite cling times. By use of the term "infinite cling time" it is meant that the composition when sprayed onto a vertical surface will dry (but is not a solid) before it will run or drip.

Without limitation, some examples of one or more alkalinity sources include one or more of an alkanolamine, alkali metal carbonate, alkali metal hydroxide, or borate. Further, as well as specific, examples of one or more alkalinity sources are set forth in the description that follows below. As to an amount of one or more alkalinity sources, in one aspect it may be that amount that is sufficient to provide a free alkalinity (expressed as weight percent $Na_2O$) from about 0.1 wt % to about 1.0 wt %, based on the total weight of the cleaner composition, and a total alkalinity (expressed as expressed as weight percent $Na_2O$) of greater than about 0.1 wt % to about 2.0 wt %, based on the total weight of the cleaner composition. To that end, in one aspect the one or more alkalinity sources may be from about 0.1 wt % to about 2.0 wt %, based on the total weight of the cleaner composition. In another aspect, the one or more alkalinity sources may be from about 0.1 wt % to about 1.5 wt %, based on the total weight of the cleaner composition. In yet another aspect, the one or more alkalinity sources may be from about 0.5 wt % to about 1.5 wt %, based on the total weight of the cleaner composition.

Without limitation, some examples of one or more chelants comprise one or more of a tetrasodium glutamate diacetate, aminocarboxylate, ethanol glycine, polyacrylate, gluconate, glutamate or citrate. Further, as well as specific, examples of one or more chelants are set forth in the description that follows below. As to an amount of one or more chelants, in one aspect it may be from about 0.1 wt % to about 5.0 wt %, based on the total weight of the cleaner composition. In other aspects, the one or more chelants may be from about 0.2 wt % to about 4.0 wt %, based on the total weight of the cleaner composition. In yet other aspects, the one or more chelants may be from about 0.3 wt % to about 3.0 wt %, based on the total weight of the cleaner composition. In still yet other aspects, the one or more chelants may be from about 0.4 wt % to about 2.0 wt %, based on the total weight of the cleaner composition.

Without limitation, some examples of one or more surfactants comprise one or more of an anionic surfactant, nonionic surfactant, cationic surfactant, or amphoteric (or zwitterionic) surfactant. Further, as well as specific, examples of one or more surfactants are set forth in the description that follows below. As to an amount of one or more surfactants, in one aspect it may be from about 0.1 wt % to about 3.0 wt %, based on the total weight of the cleaner composition. In another aspect, the one or more surfactants may be about 0.1 wt % to about 2.5 wt %, based on the total weight of the cleaner composition. In yet another aspect, an amount of one or more surfactants may be about 0.1 wt % to about 2.0 wt %, based on the total weight of the cleaner composition.

A method of preparing a grease-removing ready-to-use cleaner is provided. The method includes the steps of first dispersing a thickening agent in water to create a homogenous acidic dispersion. The acidic dispersion is next neutralized with a chelant. In some embodiments the neutralizing chelant is comprised of tetrasodium glutamate diacetate. Additional water may be added to the neutralized dispersion. The next step includes adding more components to the neutralized dispersion, the additional components include one or more alkalinity sources present in an amount sufficient to provide a free alkalinity (expressed as weight percent $Na_2O$) of less than about 1.0 wt %, based on the total weight of the cleaner composition, and a total alkalinity (expressed as weight percent $Na_2O$) of less than about 2.0 wt %, based on the total weight of the cleaner composition, between 0.1 wt % to about 3.0 wt % of one or more surfactants, one or more buffering agents to provide a pH of less than about 11.5 in the ready-to-use composition, and between about 3.0 wt % to about 8.0 wt % of a combination of one or more solvents. The method of preparing a thickened ready-to-use degreaser according to the invention results in a composition substantially free of phosphorous, safe to handle without mask or gloves, substantially free of volatile organic compounds, and does not drip or run when sprayed on a vertical surface.

Accordingly, aspects of embodiments and embodiments of the present invention are directed to thickened cleaner compositions. Such cleaner compositions include one or more alkalinity sources, one or more chelants, one or more surfactants, one or more thickeners, and optional additional ingredients such as hydrotropes, corrosion inhibitors, dyes and fragrances and, as a remainder, water. The one or more alkalinity sources may be present in an amount sufficient to provide a free alkalinity (expressed as weight percent $Na_2O$) of less than about 0.9 wt %, based on the total weight of the cleaner composition, and a total alkalinity (expressed as weight percent $Na_2O$) less than about 1.5 wt %, based on the total weight of the cleaner composition. The one or more chelants may be present in an amount from about 0.1% to about 5.0%. The one or more solvents may be present in an amount from about 3.0 to about 8.0 wt %. The one or more surfactants may be present in an amount from about 0.1 wt % to about 3.0 wt %, based on the total weight of the cleaner composition. The thickener may be present in an amount from about 0.1 to about 2.0 wt % of the total weight of the cleaner composition. As stated, optional ingredient such as hydrotropes, corrosion inhibitors, dyes, and or fragrances may be included in the invention composition. The remainder to 100 wt % may be water, based on the total weight of the cleaner composition.

Other aspects and embodiments of the present invention are directed to cleaners formulated to be capable of removing baked on soils originating from a fat and/or oil from the food service industry from a vertical or inverted surface. Such cleaners include one or more thickening agents, one or more alkalinity sources, one or more chelants, one or more surfactants, one or more solvent and, as a remainder, water. The one or more alkalinity sources may be from about 0.8 wt % to about 1.4 w %, based on the total weight of the cleaner. The one or more chelants may be from about 0.1 wt % to about 5.0 wt %, based on the total weight of the cleaner. The one or more surfactants may be up to about 3.0 wt. %, based on the total weight of the cleaner. The one or more thickeners may be up to about 2.0 wt. %, based on the total weight of the cleaner. The one or more solvents may be present in an amount from about 3.0 to about 8.0 wt %. The remainder to 100 wt % may be water, based on the total weight of the cleaner. In some aspects, cleaners further include up to about 1.5 wt % of one or more hydrotropes, based on the total weight of the cleaner. In yet other aspects, the cleaners further include one or more buffers. When used, an amount of one or more buffers may be up to about 5.0 wt %, based on the total weight of the cleaner. Further, as well as more specific, examples of amounts of the number of ingredients are set forth in the description section that follows below.

Still yet other aspects and embodiments of the present invention are directed to methods of preparing cleaners formulated to be capable of removing from a vertical or inverted surface soils originating from a fat and/or oil that may include fats and/or oils from the food service industry. Such cleaners may consist essentially of one or more alkalinity sources, one or more chelants, one or more surfactants, one or more buffers, one or more hydrotropes, one or more thickening agents, and, as a remainder, water. In some aspects, the composition consists of two alkalinity sources from about 0.1 wt % to about 2.0 wt %, based on the total weight of the cleaner, and the a chelant from about 0.1 wt % to about 5.0 wt %, based on the total weight of the cleaner, a combination of three surfactants of up to about 3.0 wt %, based on the total weight of the cleaner, a combination of two solvents may be present in an amount from about 3.0 to about 8.0 wt % based on the total weight of the cleaner, a buffer up to about 5.0 wt %, based on the total weight of the cleaner, a hydrotrope up to about 1.5 wt %, based on the total weight of the cleaner, a thickening agent up to about 2.0 wt %, based on the total weight of the cleaner, and the remainder to 100 wt % may be water, based on the total weight of the cleaner. Further, as well as more specific, examples of amounts of the number of ingredients are set forth in the description section that follows below.

Still yet other aspects and embodiments of the present invention are directed to methods for removing from a surface soils originating from a fat and/or oil that may include fats and/or oils from the food service industry. Such methods include the steps of formulating a cleaner, communicating the cleaner with a soiled vertical or inverted surface, and removing any residue from the surface thereby cleaning the surface. The formulating includes combining a sufficient amount of cleaner composition as described. The contacting of the cleaner with the vertical or inverted soiled surface includes doing so for at least a sufficient amount of time to allow the cleaner to interact with the soil of the soiled surface.

In other aspects, the one or more fats and/or oils of the soil include one or more triglycerides. In yet other aspects, at least a portion of the triglycerides are baked-on.

It has surprisingly been found that the order of addition of the ingredients of the present composition yields a composition having superior cling properties than if the same ingredients were added in a different order. When it is said that the composition has superior cleaning ability it is meant that the composition removes grease and baked on soil better than its counterparts.

Embodiments of the present invention include a composition that is substantially free of phosphates, phosphorous, or phosphonates, volatile organic compounds, have a relatively high flash point, low vapor pressure and a pH of below about 11.5.

DESCRIPTION

As used herein, the term "phosphate-free" refers to a composition, mixture, or ingredient that does not contain a phosphate or phosphate-containing compound or to which a phosphate or phosphate-containing compound has not been added. Should a phosphate or phosphate-containing compound be present through contamination of a phosphate-free composition, mixture, or ingredients, the amount of phosphate shall be less than 0.5 wt %. More preferably, the amount of phosphate is less than 0.1 wt %, and most preferably, the amount of phosphate is less than 0.01 wt %.

As used herein, the term "phosphorous-free" refers to a composition, mixture, or ingredient that does not contain a phosphorous or phosphorous-containing compound or to which a phosphorous or phosphorous-containing compound has not been added. Should a phosphorous or phosphorous-containing compound be present through contamination of a phosphorous-free composition, mixture, or ingredients, the amount of phosphorous shall be less than 0.5 wt %. More preferably, the amount of phosphorous is less than 0.1 wt %, and most preferably, the amount of phosphorous is less than 0.01 wt %.

As used herein, the term "free of volatile organic compounds" or "free of VOCs" refers to a composition, mixture, or ingredient that does not contain a volatile organic compound or to which a volatile organic compound has not been added. VOCs are defined by California code of Regulations Title 17 §§94507-94517 Amendment 2010 which definition is hereby incorporated by reference for all purposes. Should a volatile organic compound be present through contamination of a volatile organic compound-free composition, mixture, or ingredients, the amount of volatile organic shall be less than 0.5 wt %. More preferably, the amount of volatile organic compound is less than 0.1 wt %, and most preferably, the amount of volatile organic compound is less than 0.01 wt %.

"High Vapor Pressure Solvents" as used herein refers to solvents having a vapor pressure of greater than 0.1 mmHg when measured at 20° C.

"Low Vapor Pressure Solvents" as used herein refers to solvents having a vapor pressure of less than 0.1 mmHg when measured at 20° C.

"High Flash Point" as used herein refers to a composition or to a component of a composition having a flash point of greater than about 100° C.

"Baked on" refers to soils that have either splattered, spilled, or have been aspirated during a baking operation or have spilled, splattered, or been aspirated before a baking operation and have not been removed before commencement of the next baking operation. A soil is said to have been "baked on" if the soil is exposed to baking temperatures for at least a portion of a baking operation up to numerous successive baking operations thereby making the soil much more difficult to remove compared to if it was removed before commencement of a baking operation.

"Cleaning" means to perform or aid in soil removal, bleaching, microbial population reduction, rinsing, or combination thereof.

The terms "thickening agent" and "thickener" are used interchangeably herein. Both terms refer to a compound that when added to a liquid composition causes the viscosity of that composition to substantially increase.

As used herein, weight percent (wt %), percent by weight, % by weight, and the like are synonyms that refer to the concentration of a substance as the weight of that substance divided by the total weight of the composition and multiplied by 100.

As used herein, the term "about" modifying the quantity of an ingredient in the compositions of the invention or employed in the methods of the invention refers to variation in the numerical quantity that can occur, for example, through typical measuring and liquid handling procedures used for making use solutions in the real world; through inadvertent error in these procedures; through differences in the manufacture, source, or purity of the ingredients employed to make the compositions or carry out the methods; and the like. The term about also encompasses amounts that differ due to different equilibrium conditions for a composition resulting from a particular initial mixture. Whether or not modified by the term "about", the claims include equivalents to the quantities.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

In the interest of brevity and conciseness, any ranges of values set forth in this specification contemplate all values within the range and are to be construed as support for claims reciting any sub-ranges having endpoints which are real number values within the specified range in question. By way of a hypothetical illustrative example, a disclosure in this specification of a range of from 1 to 5 shall be considered to support claims to any of the following ranges: 1-5; 1-4; 1-3; 1-2; 2-5; 2-4; 2-3; 3-5; 3-4; and 4-5.

The term "substantially free" may refer to any component that the composition of the invention lacks or mostly lacks. When referring to "substantially free" it is intended that the component is not intentionally added to compositions of the invention. Use of the term "substantially free" of a component allows for trace amounts of that component to be included in compositions of the invention because they are present in another component. However, it is recognized that only trace or de minimus amounts of a component will be allowed when the composition is said to be "substantially free" of that component. Moreover, the term if a composition is said to be "substantially free" of a component, if the component is present in trace or de minimus amounts it is understood that it will not affect the effectiveness of the composition. It is understood that if an ingredient is not expressly included herein or its possible inclusion is not stated herein, the invention composition may be substantially free of that ingredient. Likewise, the express inclusion of an ingredient allows for its express exclusion thereby allowing a composition to be substantially free of that expressly stated ingredient.

As used herein the term, "consisting essentially of" in reference to a composition refers to the listed ingredients and does not include additional ingredients that, if present, would affect the cleaning ability of the cleaning composition. The term "consisting essentially of" may also refer to a component of the cleaning composition. For instance, a surfactant package may consist essentially of two or more surfactants and such surfactant package would not include any other ingredients that would affect the effectiveness of that surfactant package—either positively or negatively. As used herein the term "consisting essentially of" in reference to a method of cleaning refers to the listed steps and does not include additional steps (or ingredients if a composition is included in the method) that, if present, would affect the cleaning ability of the cleaning method.

Free Alkalinity (expressible as wt % $Na_2O$) and Total Alkalinity (expressible as wt % $Na_2O$) may be determined by taking a 2-3 gram sample of a composition and adding 100 mL deionized water and titrating the sample using an autotitrator. The sample may also be manually titrated. Calculations to report the measured wt % activity of free alkalinity (expressed as wt % $Na_2O$) and wt % total alkalinity (expressed as wt % $Na_2O$) are shown below:

wt % Active Alkalinity (as $Na_2O$):

$$\text{wt \% Alkalinity as } Na_2O = \frac{(\text{mL HCl to pH 8.3})(N\ \text{HCl})(31)(100)}{(\text{g sample titrated})}$$

wt % Total Alkalinity (as $Na_2O$):

$$\text{wt \% Alkalinity as } Na_2O = \frac{(\text{mL HCl to pH 4.0})(N\ \text{HCl})(31)(100)}{(\text{g sample titrated})}$$

"Travel" as used herein refers to the distance or rate that a sample formulation moves when sprayed on a vertical surface. "Travel" is used synonymously with dripping or running of a composition. A composition that is said not to "travel" does not run or drip when sprayed onto a vertical surface. These and other aspects, advantages, and salient features of the present invention will become apparent from the following description and the appended claims.

I. Cleaner Composition

As noted, aspects of embodiments and embodiments of the present invention relate to the cleaner compositions and/or cleaners that may include a number of ingredients. Such ingredients may provide desired characteristics to cleaners. Examples of such ingredients include one or more alkalinity sources, one or more surfactants, and one or more chelants, optionally one or more hydrotropes, one or more corrosion inhibitors, one or more buffers, one or more thickening agents, a combination of two solvents. A hydrated thickening agent is included to provide a ready to use solution having a viscosity of about 400-800 cps. A description of each class of ingredients of the cleaner compositions and/or cleaners follows.

A. One or More Alkalinity Sources

Aspects of embodiments of the present invention relate to the one or more alkalinity sources and cleaners. Suitable alkalinity sources include, but are not limited to, one or more organic alkalinity sources, one or more inorganic alkalinity sources, or combinations thereof. Suitable organic alkalinity sources include, but are not limited to, strong nitrogen bases including, for example monoethanolamine, monopropanolamine, diethanolamine, dipropanolamine, triethanolamine, tripropanolamine, and the like, or combinations thereof. Suitable inorganic alkalinity sources include, but are not limited to, alkali metal hydroxides (e.g., sodium hydroxide, potassium hydroxide, lithium hydroxide, and the like, or combinations thereof), alkali metal carbonates (e.g., sodium carbonate, potassium carbonate, sodium bicarbonate, potassium bicarbonate, sodium sesquicarbonate, potassium sesquicarbonate, and the like, or combinations thereof), alkali metal borates (e.g., sodium borate, potassium borate, and the like, or combinations thereof), alkali metal oxides (e.g., sodium oxide, potassium oxide, and the like, or combinations thereof), and the like, or combinations thereof.

As to an amount of one or more alkalinity sources, in one aspect it may be that amount that is sufficient to provide free alkalinity (expressed as wt percent $Na_2O$) of less than about 1.0 wt %, based on the total weight of the cleaner composition, and a total alkalinity (expressed as expressed as weight percent $Na_2O$) of less than about 2.0 wt %, based on the total weight of the cleaner composition.

A number of commercially available alkalinity sources may be suitable for use in aspects of embodiments or embodiments of the present invention. Commercially available alkalinity sources may be obtained from a variety of vendors including, but not limited to, PPG Industries (Pittsburgh, Pa.), Dow Chemical Company (Midland, Mich.), and Angus Chemical Company (Buffalo Grove, Ill.). For example, suitable commercially available amino alcohols include, but are not limited to, AMP-95™ primary amino alcohol (2-Amino-2-methyl-1-propanol+5% water) and AMP-90™ amino alcohol (2-Amino-2-methyl-1-propanol+10% water) available from Angus Chemical Company (Buffalo Grove, Ill.). Suitable commercially available caustic soda include, but are not limited to, liquid caustic soda (sodium hydroxide) as 50% (alkali equivalent, wt % $Na_2O$ about 39%) and 73% (alkali equivalent, wt % $Na_2O$ about 57%) solutions in water available from PPG Industries. (Pittsburgh, Pa.). Suitable commercially available alkyl alkanolamines include, but are not limited to, monoethanolamine ($HOCH_2CH_2NH_2$) as MEA grade, MEA LFG grade (an 85% solution of monoethanolamine with 15% water), and MEA ICF grade available from Dow Chemical Company (Midland, Mich.).

In an embodiment the alkalinity source is selected from the group consisting of alkali metal hydroxides and alkanolamines. It is surprising that compositions of the invention are effective at removing baked on soils even though the compositions have a relatively low caustic (alkali metal hydroxide) content and relatively low alkalinity content.

B. One or More Surfactants

Aspects of embodiments of the present invention include one or more surfactants. Suitable surfactants include, but are not limited to, natural surfactants (e.g., surfactants based on natural components such as fatty acids, coconut oil, and the like, or combinations thereof), anionic surfactants, cationic surfactants, nonionic surfactants, amphoteric surfactants (or zwitterionic surfactant), and the like, or combinations thereof. Natural surfactants include, but are not limited to, soaps such as coconut-based soap solutions.

Anionic surfactants include, but are not limited to, one or more of a carboxylate such as, without limitation, alkylcarboxylates (e.g., carboxylic acid and/or its salts), polyalkoxycarboxylates (e.g., polycarboxylic acid and/or its salts), alcohol ethoxylate carboxylates, and the like, or combinations thereof; sulfonate such as, without limitation, alkylsulfonates, alkylbenzenesulfonates (e.g., dodecyl benzene sulfonic acid and/or its salts), alkylarylsulfonates, sulfonated fatty acid esters, and the like, or combinations thereof; sulfate such as, without limitation, sulfated alcohols, sulfated alcohol ethoxylates, sulfated alkylphenols, alkylsulfates, sulfosuccinates, alkylether sulfates, and the like, or combinations thereof. Exemplary anionic surfactants include sodium alkylarylsulfonate, alpha-olefinsulfonate, fatty alcohol sulfates, and the like, or combinations thereof.

Cationic surfactants include, but are not limited to, alkoxylated cationic ammonium surfactants, and the like, or combinations thereof.

Nonionic surfactants include, but are not limited to, alkanolamides, alkyl polyglycocides, and the like, or combinations thereof. Such nonionic surfactants include one or more polyalkylene oxide polymer as a portion of the surfactant molecule. Examples of nonionic surfactants include, without limitation, benzyl-, methyl-, ethyl-, propyl-, butyl- and other like alkyl-capped polyethylene glycol ethers of fatty alcohols, and the like, or combinations thereof; polyalkylene oxide free nonionics such as, without limitation, alkyl polyglycosides, and the like, or combinations thereof; sorbitan esters, sucrose esters, sorbitan esters ethoxylates, sucrose ester ethoxylates, and the like, or combinations thereof; alkoxylated ethylene diamine; alcohol alkoxylates such as, without limitation, alcohol ethoxylates (SURFONIC® L12-6 commercially available from Huntsman), alcohol ethoxylate propoxylates, alcohol propoxylates, alcohol propoxylate ethoxylate propoxylates, alcohol ethoxylate butoxylates, and the like, or combinations thereof; polyoxyethylene glycol ethers, and the like, or combinations thereof; amine oxides, and the like, or combinations thereof; carboxylic acid esters such as, without limitation, glycerol esters, polyoxyethylene esters, ethoxylated and glycol esters of fatty acids, and the like, or combinations thereof; carboxylic amides such as, without limitation, diethanolamine condensates, monoalkanolamine condensates, polyoxyethylene fatty acid amides, and the like, or combinations thereof; and polyalkylene oxide block copolymers including an ethylene oxide/propylene oxide block copolymer such as those commercially available under the trademark PLURONIC® (BASF), and the like, or combinations thereof; other like nonionic compounds; or combinations thereof.

Amphoteric surfactants (or zwitterionic surfactants) include, but are not limited to, imidazoline derivatives, betaines, imidazolines, sultaines, propionates, and the like, or combinations thereof.

Silicone surfactants such as the ABIL® B8852 may also be used.

As to an amount of one or more surfactants, in some aspects it may be may be from about 0.1 wt % to about 3.0 wt %, based on the total weight of the cleaner composition. In other aspects, the one or more surfactants may be from about 0.1 wt % to about 2.5 wt %, based on the total weight of the cleaner composition. In yet other aspects the one or more surfactants may be from about 0.1 wt % to about 2.0 wt %, based on the total weight of the cleaner composition.

A number of commercially available surfactants may be suitable for use in aspects of embodiments and/or embodiments of the present invention. Commercially available surfactants may be obtained from a variety of vendors including, but not limited to, Cognis Oleochemicals LLC and/or Cognis USA (Cincinnati, Ohio), Dow Chemical Company (Midland, Mich.), Huntsman Performance Products (The Woodlands, Tex.), Tomah Products, Inc (Milton, Wis.), Air Products and Chemicals, Inc (Allentown, Pa.), Stepan Company (Northfield, Ill.), Rhodia Inc. (Cranbury, N.J.), Clariant Corporation (Charlotte, N.C.), and Nease Corporate (Cincinnati, Ohio). For example, suitable commercially available amphoteric surfactants include, but are not limited to, MIRANOL® HMA sodium lauroampho acetate (38% solids) and MIRANOL® ULTRA L32 sodium lauroampho acetate available from Rhodia Novecare (Cranbury, N.J.). Suitable commercially available linear alcohol ethoxylates include, but are not limited to, SURFONIC® L12-6 six-mole ethoxylate of linear, primary 10-12 carbon number alcohol available from Huntsman Performance Products (The Woodlands, Tex.). Suitable commercially available alkyl sulfates include, but are not limited to, POLYSTEP® B-29 sodium octyl sulfate available from Stepan Company (Northfield, Ill.). Optionally, suitable commercially available nonionic surfactants include, but are not limited to, oxo-alcohol polyglycol ethers such as GENAPOL® UD 070 C11-oxo-alcohol polyglycol ether (7 EO) available from Clariant Corporation (Cranbury, N.J.). Suitable commercially available linear alkylbenzene sulfonic acids and their salts include, but are not limited to, NAXSOFT® 98S dodecyl benzene sulfonic acid and NAXSOFT® 40S sodium dodecyl benzene sulfonate available from Nease Corporate (Cincinnati, Ohio).

In an aspect of the invention, a combination of surfactants is included in the composition. Such combination of surfactants may be selected from the group consisting essentially of ethoxylated alcohols, alkyl sulfates, and alkyl amphoacetates.

In another embodiment such combination of surfactants is selected from the group consisting of ethoxylated alcohols, alkyl sulfates, and alkyl amphoacetates.

C. One or More Chelants (and/or Sequestrants)

Aspects of embodiments of the present invention relate to one or more chelants and cleaner compositions and/or cleaners. To that end, the cleaner compositions and/or cleaners of the present include one or more chelants (used interchangeably herein with one or more sequestrants) that prevent the formation of precipitates or other salts. In another aspect, the one or more chelants also may function to remove baked-on and/or polymerized (e.g., by oxidation, heat, free radical, and the like, or combinations thereof) soils and/or carbonized fats and oils from a surface and suspend these products in a cleaner. Any number of chelants may be used in accordance with aspects of embodiments and/or embodiments of the present invention. Examples of one or more chelants include, but are not limited to, salts of aminocarboxylic acids, glutamic acid and glutamic acid salts, gluconates such as gluconic acid and gluconic acid salts, ethanol diglycinate salts, water soluble acrylic polymers, iminodisuccinate, tetrasodium glutamate diacetate and the like, or combinations thereof.

Thus, it will be appreciated that suitable chelants for use in the present invention include, but are not limited to, organic compounds, inorganic compounds, or combinations thereof. The number of covalent bonds capable of being formed by a chelant upon a single hardness ion may be reflected by labeling the chelants as bidentate (2), tridentate (3), tetradendate (4), and the like.

In aspects of one embodiment, the one or more chelants are organic. Nonlimiting examples of organic chelants include the salts or acid form of nitriloacetic acid and its derivatives, amino carboxylates, amides, polycarboxylates, salicylates and their derivatives, derivatives of polyamino compounds, and the like, or combinations thereof. Nonlimiting examples of nitriloacetic acid derivatives include, but are not limited to, sodium nitriloacetate, magnesium nitriloacetate, and the like, or combinations thereof. Nonlimiting examples of amino carboxylates include sodium iminosuccinates, and the like, or combinations thereof. Nonlimiting examples of inorganic chelants include sodium aluminosilicates and zeolites.

Nonlimiting examples of polycarboxylates include citric acid and it salts and derivatives, sodium glutarate, potassium succinate, polyacrylic acid and its salts and derivatives, copolymers, and the like, or combinations thereof. Nonlimiting examples of polyamino compounds include ethylene diamine (e.g., ethylenediaminetetraacetic acid {EDTA}, ethylenediaminoetetraproprionic acid), ethylene triamine (e.g., diethyltriaminepentaacetic acid {DTPA}), ethylene tetraamine (e.g., triethylenetetraaminoehexaacetic acid {TTHA}), hydroxyethylene diamine (e.g., N-hydroxyethyliminodiacetic acid, nitrolotriacetic acid {NTA}, N-hydroxyethylethylenediaminetriacetic acid {HEDTA}), ethanoldiglycine (EDG a.k.a. hydroxyethyliminodiacetic acid {HEIDA}), diethanolglycine (DEG), 1,3-propylenediaminoetetraacetic acid (PDTA), dicarboxymethyl glutamic acid (GLDA), methylglycine-N-N-diacetic acid (MGDA), iminodisuccinate acid (IDA), their respective alkali metal (e.g., Li, Na, K, and the like, or combinations thereof) salts, their respective ammonium salts, their respective substituted ammonium salts, their derivatives, and the like, or combinations thereof.

Nonlimiting examples of polyacrylic acid and its salts and derivatives include water soluble acrylic polymers. Such polymers include, but are not limited to, polyacrylic acid, polymethacrylic acid, acrylic acid, acrylic acid-methacrylic acid copolymers, polymaleic acid, hydrolyzed polyacrylamide, hydrolyzed methacrylamide, hydrolyzed acrylamide-methacrylamide copolymers, hydrolyzed polyacrylonitrile, hydrolyzed polymethacrylonitrile, hydrolyzed acrylonitrile methacrylonitrile copolymers, and the like, or combinations thereof or copolymers thereof. Water soluble salts or partial salts of these polymers such as their respective alkali metal (e.g., sodium, potassium, or combinations thereof) or ammonium salts can also be used.

In one aspect, the weight average molecular weight of the polymers may be from about 4000 to about 12,000. In another aspect, polymers include, but are not limited to, polyacrylic acid, the partial sodium salts of polyacrylic acid or sodium polyacrylate having an average molecular weight within the range of 4000 to 8000.

In some aspects the one or more chelants may be from about 0.1 wt % to about 5.0 wt %, based on the total weight of the cleaner composition. In other aspects the one or more chelants may be from about 0.2 wt % to about 4.0 wt %, based on the total weight of the cleaner composition. In yet other aspects the one or more chelants may be from about 0.3 wt % to about 3.0 wt %, based on the total weight of the cleaner composition. In still yet other aspects the one or more chelants may be from about 0.4 wt % to about 2.0 wt %, based on the total weight of the cleaner composition.

A number of commercially available chelants may be suitable for use in aspects of embodiments and/or embodiments of the present invention. Commercially available chelants may be obtained from a variety of vendors including, but not limited to, BASF Corporation (Florham Park, N.J.), Dow Chemical Company (Midland, Mich.), and LANXESS Corporation (Pittsburgh, Pa.). For example, suitable commercially available biodegradable methylglycinediacetic acid (MGDA) chelants include, but are not limited to, TRILON® M methylglycinediacetic acid, trisodium salt while aminocarboxylate chelants include, but are not limited to, TRILON® A nitrilotriacetic acid (NTA), TRILON® B ethylenediaminetetraacetic acid (EDTA), TRILON® C diethylenetriaminepentaacetic acid (DTPA), TRILON® M hydroxyethylethylenediaminetriacetic acid (HEDTA) available from BASF Corporation (Florham Park, N.J.). Also suitable commercially available chelants include, but are not limited to, VERSENE® (HEIDA) 2-hydroxyethyliminodiacetic acid, disodium salt from Dow Chemical Company (Midland, Mich.) and dicarboxymethyl glutamic acid (GLDA) from Akzo Nobel. Other suitable commercially available biodegradable chelants include, but are not limited to, BAYPURE® tetrasodium iminodisuccinate and BAYPURE® sodium polyaspartate available from LANXESS Corporation (Pittsburgh, Pa.).

In an embodiment the chelant consists of tetrasodium glutamate diacetate available as DISSOLVINE GL-47 S from Akzo Nobel.

D. One or More Thickening Agents

Ready to use solutions prepared using cleaner compositions of the invention include one or more thickening agents. It has surprisingly been found that suitable thickening agents include polycarboxylic acids such as polyacrylic acid. In comparative tests, other thickening agents such as xanthan gum were tested. The other tested thickening agent resulted in phase separation which was unsuitable. Cleaner compositions including polyacrylic acid, on the other hand, remained monophasic over extended shelf life, provided a suitable viscosity allowing the cleaner to adhere to a vertical or inverted surface for sufficient contact time to remove the particular soil it was attacking. A commercially available polyacrylic acid thickening agent is sold under the trade name CUSTAPOLY from Custom Ingredients located in Chester, S.C. In some aspects the one or more thickening agent may be from about 0.1 wt % to about 2.0 wt %, based on the total weight of the cleaner composition. In other aspects the one or more thickening agent may be from about 0.2 wt % to about 1.8 wt %, based on the total weight of the cleaner composition. In yet other aspects the one or more thickening agent may be from about 0.3 wt % to about 1.6 wt %, based on the total weight of the cleaner composition. In still yet other aspects the one or more thickening agent may be from about 0.4 wt % to about 1.4 wt %, based on the total weight of the cleaner composition.

The ready to use cleaner composition has a viscosity of about 300 to about 2000 cps, about 400 to about 1,200 cps, about 500 to about 900 cps, about 600 to about 800 cps. In an embodiment a sufficient amount of thickening agent is provided in a ready to use solution such that the solution sprayed from a foaming dispenser onto a vertical surface will cling to a vertical surface with a creep rate of less than about 4 cm/second, of less than about 3 cm/second, less than about 2 cm/second, or less than about 1 cm/second and up to zero or 0.0 cm/second for composition expressing an "infinite cling."

E. One or More Hydrotropes

Aspects of embodiments and embodiments of the present invention may include one or more hydrotropes in cleaner compositions and/or cleaners. A hydrotrope is a material often used in a cleaner composition and/or cleaner to maintain a single phase neat or aqueous composition or solubilisate (liquid solution). Such hydrotrope may also be used in aspects of embodiments and/or embodiments of the present invention. Hydrotropy is a property that relates to the ability of a material to improve the solubility or miscibility of a substance in liquid phases in which the substance tends to be insoluble. Materials that provide hydrotropy are called hydrotropes and are used in relatively lower concentrations than the materials to be solubilized. A hydrotrope modifies a formulation to increase the solubility of an insoluble substance or creates micellar or mixed micellar structures resulting in a stable suspension of the insoluble substance. The hydrotropic mechanism is not thoroughly understood. Apparently either hydrogen bonding between primary solvent, in this case water and the insoluble substance are improved by the hydrotrope or the hydrotrope creates a micellar structure around the insoluble substance to maintain the substance in a suspension/solution. According to aspects of embodiments of the present invention, the hydrotropes are useful in maintaining the ingredients of a cleaner composition and/or cleaner in a uniform solution (e.g., solubilisate) both during manufacture and when dispersed at the use location. The one or more surfactants according to aspects of embodiments of the invention alone or when combined with a chelant may be partially incompatible with an aqueous solution and can undergo a phase change or phase separation during storage of the solution. The hydrotrope maintains a single phase solution (e.g., solubilisate) having the ingredients uniformly distributed throughout a cleaner composition and/or cleaner in an aqueous or non-aqueous form. As to an amount of one or more hydrotropes, in one aspect it may be from about 0 wt % to about 1.5 wt %, based on the total weight of the cleaner composition. In other aspects the one or more hydrotropes may be from about 0.01 wt % to about 1.0 wt % based on the total weight of the cleaner composition. In yet other aspects the one or more hydrotropes may be from about 0.05 wt % to about 0.5 wt % based on the total weight of the cleaner composition. Hydrotropes exhibit hydrotropic properties in a broad spectrum of chemical molecule types. Hydrotropes generally include ether compounds, alcohol compounds, anionic surfactants, cationic surfactants, and the like, or combinations thereof. One hydrotrope usable according to aspects of embodiments of the invention include aromatic sulfonic acid, sulfonated hydrotropes such as C1-C5 substituted benzene sulfonic acid, naphthalene sulfonic acid, and the like, or combinations thereof. Examples of such a hydrotrope are xylene sulfonic acid, toluene sulfonic acid, naphthalene sulfonic acid, salts of xylene sulfonic acid (e.g., xylenesulfonic acid, sodium salt; xylenesulfonic acid, ammonium salt; xylenesulfonic acid, calcium salt; and/or xylenesulfonic acid, potassium salt; cumenesulfonic acid, sodium salt; and/or cumenesulfonic acid, ammonium salt), salts of toluene sulfonic acid (e.g., toluenesulfonic acid, sodium salt; and/or toluenesulfonic acid, potassium salt), salts of naphthalene sulfonic acid, and the like, or combinations thereof.

Also useful are the higher glycols, polyglycols, polyoxides, glycol ethers, propylene glycol ethers, and the like, or combinations thereof. Suitable commercially available biodegradable hydrotropic surfactants include dipropionates such as, but not limited to, MIRATAINE® H2C HA disodium lauriminodipropionate available from Rhodia Novecare (Cranbury, N.J.). Additional useful hydrotropes include the free acids, alkali metal salts of sulfonated alkylaryls such as alkylated diphenyloxide sulfonates, toluene, xylene, cumene and phenol or phenol ether sulfonates or alkoxylated diphenyl oxide disulfonates (DOWFAX® materials); alkyl and dialkyl naphthalene sulfonates, alkoxylated derivatives, and the like, or combinations thereof.

A number of commercially available hydrotropes may be suitable for use in aspects of embodiments and/or embodiments of the present invention. Commercially available hydrotropes may be obtained from a variety of vendors including, but not limited to, Mason Chemical Company (Arlington Heights, Ill.), and Nease Corporate (Cincinnati, Ohio. For example, suitable commercially available hydrotropes include, but are not limited to, NAXONATE® 4L sodium xylene sulfonate, NAXONATE® 4LS sodium xylene sulfonate, NAXONATE® 4LOF sodium xylene sulfonate, NAXONATE® SX sodium xylene sulfonate, NAXONATE® 4AX ammonium xylene sulfonate, NAXONATE® 40SC sodium cumene sulfonate, NAXONATE® 45SC sodium cumene sulfonate, NAXONATE® SC sodium cumene sulfonate, NAXONATE® 4ST sodium toluene sulfonate, NAXONATE® ST sodium toluene sulfonate, and NAXONATE® 4KT potassium toluene sulfonate available from Nease Corporate (Cincinnati, Ohio).

In an embodiment the hydrotrope consists of sodium xylene sulfonate. In another embodiment the hydrotrope consists essentially of sodium xylene sulfonate.

G. One or More Buffers

Aspects of embodiments and embodiments of the present invention may include one or more buffers in the cleaner compositions and/or cleaners. Care must be taken when determining whether to include a buffer into compositions of the invention. Including one or more buffers may result in a pH that is not optimal for a given cleaner composition and may result in a reduction or limitation of the cleaner's effectiveness. For example, cleaners' ingredients may be sensitive to the pH in the surrounding environment. Accordingly, altering the pH of the aqueous environment to which the cleaners' ingredients are introduced regulates the ability of such ingredients to solublize a soil present on a surface.

As a result, the one or more buffers generally maintain the pH of the environment within which the cleaners' ingredients works to a pH of about 8 to about 12. To that end, in aspects cleaner compositions have a pH of about 8 to about 12; in other aspects, a pH of about 9 to about 11.5; and in yet other aspects, a pH of about 10 to about 11. Generally any one or more buffers that are capable of providing an environment of the proper pH can be used in the processing cleaner compositions and/or cleaners of the present invention. When used, one or more buffers may include a base and a complementary acid. Examples of a base include, without limitation, one or more of a borate (e.g., tetraborate, borax, and the like, or combinations thereof), bicarbonate (e.g., sodium bicarbonate, mixtures of sodium bicarbonate and sodium carbonate, and the like, or combinations thereof), carbonate (e.g., sodium carbonate). Examples of complementary acids include, without limitation, one or more of an alkali metal salt of an inorganic acid, alkali metal salt of an organic acid, or organic amine salt of an organic acid, such as, without limitation, sodium, potassium or triethanolamine salts of acetic acid, boric acid, citric acid, dodecyl benzene sulfonic acid (DDBSA), lactic acid, tartaric acid, and the like, or combinations thereof.

Generally, if pH control is desired to insure a certain activity of cleaner compositions' ingredients and/or cleaners' ingredients, an appropriate type and amount of one or more buffers may be used. As to an amount of one or more buffers, in one aspect it may be up to about 5.0 wt % or more, based on the total weight of the cleaner composition. In another aspect, the one or more buffers may be about 0.01 wt % to about 5.0 wt %, based on the total weight of the cleaner composition. In yet another aspect, the one or more buffers may be about 0.01 wt % to about 3.0 wt %, based on the total weight of the cleaner composition. In still yet another aspect, an amount of one or more buffers may be about 0.01 wt % to about 1.0 wt %, based on the total weight of the cleaner composition. One or more buffers suitable, due to their overall stability and compatibility with cleaner compositions' ingredients and/or cleaners' ingredients include, without limitation, sodium bicarbonate, sodium citrate, and borax. In an embodiment the buffer consists of sodium citrate. Also, such one or more buffers are readily commercially available, for example sodium citrate from A.E. Staley Division (Decatur, Ill.) of Tate & Lyle PLC.

In an embodiment of the invention the buffer consists essentially of citric acid. In another embodiment of the invention the buffer consists of citric acid.

H. One or More Solvents

A solvent is useful in the composition of the invention to enhance certain soil removal properties. Solvents include lower alkanols, lower alkyl ethers, glycols, aryl glycol ethers and lower alkyl glycol ethers. These materials are colorless liquids with mild pleasant odors, are excellent solvents and coupling agents and may be miscible with aqueous use compositions of the invention. Examples of useful solvents include methanol, ethanol, propanol, isopropanol and butanol, isobutanol, ethylene glycol, diethylene glycol, triethylene glycol, propylene glycol, dipropylene glycol, mixed ethylene-propylene glycol ethers, ethylene glycol phenyl ether, and propylene glycol phenyl ether. Substantially water soluble glycol ether solvents include propylene glycol methyl ether, propylene glycol propyl ether, dipropylene glycol methyl ether, tripropylene glycol methyl ether, ethylene glycol butyl ether, diethylene glycol methyl ether, diethylene glycol butyl ether, ethylene glycol dimethyl ether, ethylene glycol propyl ether, diethylene glycol ethyl ether, triethylene glycol methyl ether, triethylene glycol ethyl ether, triethylene glycol butyl ether, and others. "Substantially water soluble" solvents are defined as being infinitely or 100% soluble by weight in water at 25 degrees C. "Substantially water insoluble" glycol ether solvents include propylene glycol butyl ether, dipropylene glycol butyl ether, dipropylene glycol propyl ether, tripropylene glycol butyl ether, dipropylene glycol dimethyl ether, propylene glycol phenyl ether, ethylene glycol hexyl ether, diethylene glycol hexyl ether, ethylene glycol phenyl ether, diethylene glycol phenyl ether, and others. "Substantially water insoluble" solvents are defined as 53% by weight or less of solvent is soluble in water at 25 degrees C. Preferred solvents are substantially water-insoluble solvents. For reasons of low cost, commercial availability, high flash point, and solvent strength, dipropylene glycol n-butyl ether and benzyl alcohol are preferred solvents. These preferred solvents help reduce surface tension, help solubilize grease, and help to maintain the cleaner as a stable single phase system. Such is characteristic in a Windsor IV type microemulsion.

In a an embodiment of the invention or one or more solvent(s) is present in the invention in an amount from about 3.0 up to about 8.0 percent by weight, from about 3.5 to 7 wt %, and from about 4 to 6 wt %. In an embodiment the solvent is selected from the group consisting essentially of dipropylene glycol n-butyl ether and benzyl alcohol. In another embodiment the solvent consists of dipropylene glycol n-butyl ether and benzyl alcohol.

I. Other Additives

According to aspects of embodiments and embodiments of the present invention, cleaner compositions and/or cleaners may contain one or more additives to provide a desired characteristic to the solution. Suitable additives include, but are not limited to, one or more dyes, pigments, preservatives, antimicrobial agents, corrosion inhibitors, bleaching agents, bleach activators, abrasives, anti-redeposition agents, softeners, conditioners, fragrances and the like, or combinations thereof. In an aspect of one embodiment, the cleaner compositions and/or cleaners comprise at least one dye to provide a desirable color.

A corrosion inhibitor, when added to the compositions of the invention, may include or may consist essentially of sodium or potassium silicate.

Typically, additives, such as those mentioned above, are each individually present in an amount of less than about 2.0 wt %, based on a total weight of the cleaner composition. In aspects of embodiments, each additive, when present, is individually present in an amount ranging from about greater than zero (≧0) to about 0.75 wt %, based on a total weight of the cleaner composition.

A number of commercially available additives may be used in aspects of embodiments and/or embodiments of the present invention. Commercially available dyes suitable for use in the present invention include, but are not limited to, Yellow Dye FD&C #5 available from Pylam Products (Tempe, Ariz.); Blue Pylaklor LX 10092 available from Pylam Products (Tempe, Ariz.); Resorcine Brown 5GM available from Pylam Products (Tempe, Ariz.); and Acid Red #1 available from Keystone Aniline Corporation (Inman, S.C.).

An exemplary cleaner composition of the invention is provided in the table below:

| Description | Ingredient | Amount by weight % |
|---|---|---|
| Water | Water Zeolite Softened | 88.14 |
| Thickening Agent | Polyacrylic acid | 0.7500 |
| Chelant | Tetrasodium glutamate diacetate 47% | 1.40 |
| Alkaline Source | NaOH, 50% Liquid | 1.125 |
| Surfactant | Ethoxylated Primary Linear Alcohol C10-C14 | 0.45 |

-continued

| Description | Ingredient | Amount by weight % |
|---|---|---|
| Surfactant | Sodium Lauro Ampho Acetate, 40% | 0.750 |
| Surfactant | Alkyl Sulfate, 32% | 0.250 |
| Alkaline Source | Monoethanolamine. 99% | 0.44 |
| Buffer | Citric acid, 50% | 0.6350 |
| Hydrotrope | Sodium Xylene Sulfonate, 40% | 0.5600 |
| Solvent | Dipropylene glycol n-butyl ether | 2.50 |
| Solvent | Benzyl alcohol | 2.50 |
| Corrosion Inhibitor | Potassium silicate, 30% | 0.500 |

Another exemplary cleaner composition of the invention is provided in the table below:

| Description | Ingredient | Amount by weight % |
|---|---|---|
| Water | Tap water | 87.10 |
| Thickening Agent | Polyacrylic acid | 0.7500 |
| Chelant | hydroxyethyliminodiacetic acid, 27% | 2.440 |
| Alkaline Source | NaOH, 50% Liquid | 1.125 |
| Surfactant | Ethoxylated Primary Linear Alcohol C10-C14 | 0.45 |
| Surfactant | Sodium Lauro Ampho Acetate, 40% | 0.750 |
| Surfactant | Alkyl Sulfate, 32% | 0.250 |
| Alkaline Source | Monoethanolamine. 99% | 0.44 |
| Buffer | Citric acid, 50% | 0.6350 |
| Hydrotrope | Sodium Xylene Sulfonate, 40% | 0.5600 |
| Solvent | Dipropylene glycol n-butyl ether | 2.50 |
| Solvent | Benzyl alcohol | 2.50 |
| Corrosion Inhibitor | Potassium silicate, 30% | 0.500 |

In order to prepare a ready to use composition of the above-provided composition, 0.75 wt % polyacrylic acid (Custo-poly,™) thickening agent is allowed to hydrate in 88.14 wt % water to create an acidic dispersion. Next, 1.4 wt % tetrasodium glutamate diacetate is added to neutralize the acidic dispersion and the composition thickens more. The remaining ingredients are then added to the neutralized dispersion while mixing. The ready to use composition has a viscosity of greater than about 300 cps, greater than about 400 cps, greater than about 500 cps, greater than 600 cps and greater than 650 cps.

It was surprisingly found that if the sodium hydroxide or the monoethanolamine is used to neutralize the acidic polyacrylic acid in water combination that the resulting composition is undesirable. That is, if sodium hydroxide or the monoethanolamine is used to neutralize the combination the solution becomes very thick. Without being bound by theory it is believed that using sodium hydroxide or monoethanolamine adds too much alkalinity too quickly to allow the thickening agent/polymer to form a stable complex. Another theory believes that using sodium hydroxide or the monoethanolamine causes the pH to increase and overshoots the optimum pH causing the polymer to breakdown and a lower viscosity results. However, after addition of the remaining ingredients, the solution is less viscous (about 100 cps). Moreover, there is a substantial amount of waste because a thick gel that was not adequately mixed is left upon the mixing vessel and the resultant composition does not perform as well in the cling tests. In other words, the MEA or NaOH neutralized compositions do not have the extended cling times or infinite cling times of the composition when prepared according to the invention and instead of clinging infinitely the MEA or NaOH neutralized compositions run or drip. This is further explained in the Examples section.

Exemplary compositions may be prepared according to the method of the invention having the following ranges of components:

| Component | Amount by weight % | Amount by weight % | Amount by weight % |
|---|---|---|---|
| Water | 75-99 | 80-95 | 85-90 |
| Thickening Agent | 0.05-2.0 | 0.1-1.5 | 0.5-1.0 |
| Chelant | 0.5-3.0 | 0.75-2.5 | 1.0-2.0 |
| Alkaline Source | 0.5-3.0 | 0.75-2.5 | 1.0-2.0 |
| Surfactant | 0.5-4.0 | 0.75-3.0 | 1.0-2.5 |
| Alkaline Source | 0.05-1.5 | 0.1-1.25 | 0.25-1.0 |
| Buffer | 0.05-1.5 | 0.1-1.25 | 0.25-1.0 |
| Hydrotrope | 0.05-1.5 | 0.1-1.25 | 0.25-1.0 |
| Solvent | 3.0-10 | 3.5-8.0 | 4.0-7.0 |
| Corrosion Inhibitor | 0.01-1.5 | 0.1-1.25 | 0.25-1.0 |

II. Methods of Making the Cleaner Composition

The cleaner composition of the present invention may be prepared using conventional mixing techniques. The ingredients for forming the cleaner composition are combined at about ambient temperature. The order of addition of the components is important through the first few steps. Compositions of the invention are prepared by first hydrating the thickening agent with solvent, in this case, water. This hydrating step is also referred to as creating a dispersion. The dispersion is the thickening agent dispersed in water. The resultant dispersion is a homogenous acidic solution. The hydrating or dispersion step takes at least about 10 minutes, at least about 20 minutes, at least about 30 minutes up to about 1½ hours. In an aspect of the invention, the thickening agent is pumped into a vortex mixer containing water to ensure optimal hydration. Once the thickening agent is hydrated, additional water may be added to the dispersion.

The next step appears to be important in order to create a ready-to-use composition having suitable viscosity and cling time. By cling time it is meant the length of time that a composition remains on a vertical surface without running, dripping, creeping, or travelling. Ready-to-use degreaser compositions prepared according to the method of the invention exhibit extremely long to infinite cling times when compared to other compositions or commercially available products. When it is said that a composition exhibits an infinite cling time it means that the composition will dry, but is not a solid, to the vertical surface before it will run or drip. By extremely long cling times it is meant greater than 2 minutes, greater than 2 minutes 30 seconds, greater than 3 minutes, greater than 3 minutes 30 seconds, greater than 4 minutes, greater than 6 minutes, greater than 10 minutes, greater than 12 minutes, greater than 15 minutes, and greater than 20 minutes, greater than 1 hour, greater than 4 hours, greater than one day.

The "next step" referred to in the previous paragraph is the neutralization step of the homogenous acidic dispersion. It was surprisingly found that upon use of a chelant for such neutralization, in some aspects, tetrasodium glutamate diacetate, that the resultant composition exhibited desirable viscosity and extremely long cling times. This was as compared to using an alkalinity source such as an alkali metal hydroxide, an ethanolamine, or the like to neutralize the acidic dispersion.

Once the acidic dispersion is neutralized, the remaining ingredients are added to the thickening agent dispersion while mixing. Cleaner compositions of the invention are prepared by additionally combining: one or more alkalinity sources, one or more surfactants, one or more buffers, one or more hydrotropes (when present), one or more solvents, and one or more other additives (e.g. when present, one or more dyes, pigments, preservatives, antimicrobial agents, corrosion inhibitors, bleaching agents, bleach activators, abrasives, anti-redeposition agents, softeners, conditioners, fragrances or combinations thereof).

The viscosity of the cleaner composition without the thickening agent is less than about 50 cps, less than about 25 cps, and less than about 10 cps. The complete cleaner composition, including the thickening agent, provides a composition having a viscosity of at least about 250 cps, at least about 300 cps, at least about 400, at least about 500 cps, at least about 600 cps, and at least about 700 cps.

In one aspect of an embodiment, a cleaner composition is prepared using the following steps: (1) forming a premix by adding the thickening agent to water to a mix tank equipped with a stirrer after making sure that the mix tank is clean and allowing the thickening agent to hydrate for up to about 30 minutes, up to about 60 minutes, up to about 75 minutes; (1.5) optionally adding more water to dilute the premix; (2) adding a chelant selected from the group consisting essentially of tetrasodium glutamate diacetate or hydroxyethyliminodiacetic acid or a combination thereof to the diluted premix while mixing to form a combination; (3) adding to the combination at least one or more alkalinity sources to the combination, one or more surfactants, one or more buffers to achieve a pH in the ready-to-use composition of less than 11.5, one or more hydrotropes, one or more low vapor pressure solvents and mixing the mixture. During step (3) optional dye and/or fragrance may be added with mixing. The resultant mixture is sampled to test for desired mixture properties. In an embodiment the low vapor pressure solvents consist essentially of benzyl alcohol and dipropylene glycol n-butyl ether.

In a further desired embodiment of the present invention, a cleaner is prepared using the following steps: (1) forming a premix by adding a thickening agent (polyacrylic acid) and water to a tank, mixing and allowing the thickening agent to hydrate; (2) adding tetrasodium glutamate diacetate sold as DISSOLVINE® GL-47 chelant to the premix and mixing to form a combination; (3) adding at least one or more alkalinity sources (e.g., NaOH and monoethanolamine) to the combination while mixing; (4) letting the mixture stir until the mixture is uniform; (5) forming a combination by adding one or more surfactants to the mix tank (e.g., ethoxylated primary linear alcohol, sodium lauroampho acetate, alkyl sulfate 32%); (6) when appropriate, adding to the combination in the mix tank one or more alkalinity sources (such as sodium hydroxide and monoethanolamine 99%) and combining; (7) adding a corrosion inhibitor; (8) adding buffer such as citric acid 50% to the mix tank; (9) adding one or more hydrotropes (e.g., one or more of STEPANATE® SXS hydrotrope, MIRATAINE® H2C HA 30% hydrotrope, or propylene glycol hydrotrope) and mixing for about 15 minutes; (10) adding while mixing one or more low vapor pressure solvents; and (11) sampling the mixture to test for desired mixture properties.

In a further desired embodiment of the present invention, a cleaner is prepared using the following steps: (1) forming a premix by adding a thickening agent (polyacrylic acid) and water to a tank, mixing and allowing the thickening agent to hydrate; (2) adding hydroxyethyliminodiacetic acid chelant sold as HEIDA to the premix and mixing to form a combination; (3) adding at least one or more alkalinity sources (e.g., NaOH and monoethanolamine) to the combination while mixing; (4) letting the mixture stir until the mixture is uniform; (5) forming a combination by adding one or more surfactants to the mix tank (e.g., ethoxylated primary linear alcohol, sodium lauroampho acetate, alkyl sulfate 32%); (6) when appropriate, adding to the combination in the mix tank one or more alkalinity sources (such as sodium hydroxide and monoethanolamine 99%) and combining; (7) adding a corrosion inhibitor; (8) adding buffer such as citric acid 50% to the mix tank; (9) adding one or more hydrotropes (e.g., one or more of STEPANATE® SXS hydrotrope, MIRATAINE® H2C HA 30% hydrotrope, or propylene glycol hydrotrope) and mixing for about 15 minutes; (10) adding while mixing one or more low vapor pressure solvents; and (11) sampling the mixture to test for desired mixture properties.

According to the method of the invention it is important that step 1 occurs first, and step 2 occurs after 1, and step 3 follows step 2. The order of the following steps 4-11 does not appear to affect performance and viscosity of the resultant ready-to-use degreaser as much as the order of steps 1, 2, and 3.

III. Methods of Using the Cleaner Composition

The compositions of the present invention may be manufactured as ready to use cleaner compositions.

A. Soil Sources

Aspects of embodiments of the present invention relate to the soils to be removed and the sources of such soils. During food preparation, the use of ovens both at home and in commercial kitchens is standard. Depending upon the cooking process, food may be cooked directly on the oven surface or it may be placed within the oven in a container during cooking. In both processes food products contact and inevitably get baked on to the oven surface. This baked-on soil becomes even more difficult to clean if it is allowed to build up during successive heating cycles within the oven. When spilled, splattered, or aspirated on a surface, changes including polymerization, may occur thereby creating tenacious soils. These same tenacious soils can also be found on exhaust hoods over cooking surfaces in the food service industry.

B. Using Cleaner Generally

Aspects of embodiments of the present invention relate to methods for removing from a surface soils originating from a fat and/or oil from the food service industry. Such method may generally involve, when not already done, formulating a cleaner; communicating the cleaner with the soiled surface; and removing any residue from the surface thereby cleaning the surface. The cleaner is dispensed onto a surface using a foaming or misting sprayer from not more than 6 inches, communicated with the soiled surface for at least a sufficient amount of time to allow the cleaner to interact with the soil of the soiled surface at cold temperatures (about 32 degrees F.), up to about room temperatures (about 70 degrees F.), or up to elevated temperatures (up to about 575 degrees F.). Then, any residue may be removed from the surface thereby cleaning the surface.

In some instances, cleaners according to aspects and/or embodiments of the present inventions may be "self-working" not having a need for manual scrubbing. One interesting note upon use of the composition is that in order to ensure no waste or travel of the composition (when sprayed on a vertical or inverted surface) one should make certain not to overlap subsequent sprays over the previous spray area. The inventors have found that the first application (spray) of the composition forms a cleaning barrier over the surface and/or soil. Subsequent applications of the composition do not penetrate the prior applications and travelling (running/dripping) of the composition can occur if it is applied to itself because the composition's ability to cling appears to be to surfaces and/or soils and not to itself.

C. Using Cleaner on Appliances such as Ovens

As one may appreciate, due to the viscosity of the cleaner composition, the cleaner of the invention is suitable for cleaning and degreasing vertical and inverted surfaces. By an inverted surface we may refer to the interior top surface of an oven, the uppermost interior surface of a hood, or the like.

To that end, cleaning systems of the present invention may be used in a variety of applications including, but not limited to, household, commercial, institutional, and industrial applications. Suitable uses include, but are not limited to, cooking surfaces and cookware, such as grill surfaces, toasters, fryers, ovens, hoods, rotisseries, and popcorn poppers, such as those commonly found in the restaurant industry. Cleaners of the invention are particularly suited for cleaning heated appliances having vertical or inverted surfaces.

In an embodiment the cleaner composition is applied to the appliance surface using a foaming or misting applicator. Aspirators, aerosol dispersants, and the like are not preferred when dispensing cleaning compositions of the invention.

Cleaner compositions of the invention are effective at removing greasy soils at any temperature; however, compositions of the invention are increasingly effective at removing such baked on soils at elevated temperatures. In some methods cleaner compositions of the invention are applied to soiled surfaces having temperatures of at least 125 degrees F., at least 140 degrees F., and at least 150 degrees F., at least 175 degrees F., at least 180 degrees F., and at least 200 degrees F.

IV. Examples

In the following examples, a variety of test and/or methods were used to characterize cleaner compositions. Among these were:

Stability determination;

Cling time; and

Soil Removal determination.

Stability Determination

A cleaner composition's stability was determined by visually observing whether or not the resultant composition was homogenous. By homogenous it is meant that no phase splitting or separation occurred as in single phase Windsor IV type microemulsion.

Cling Time Determination.

Sample Preparation

Samples of a product (ready to use cleaner) are obtained. Two to three ounces (2-3 oz.) of the diluted cleaner are transferred to foaming applicators commerically available from Calmar located in (Grandview, Mo.). The samples are used for evaluating cling time as follows:

Cleaner compositions/formulations were applied to a vertical surface. The samples were tested for vertical cling by measuring the time it took for the sample to travel 11 inches reported in cm/sec.

Soil Removal Determination.

Evaluating a cleaner composition's and/or a cleaner's ability to remove a soil involves preparing substrates with a test soil as described below. Then, a candidate cleaner composition or cleaner is applied to a substrate having an appropriately prepared test soil to evaluate ability of the cleaner composition or a cleaner to remove the test soil. Details of the procedures follow:

Stainless steel panels having dimensions of 3"×5" were evenly spread with 0.05 to 1.0 grams of spent oil (obtained from a quick service restaurant and in the present examples resulting from a low linolenic soya frying oil).

The oil was allowed to carbonize by heating the panel to between about 275° F. to in an oven for approximately 3 hours and allowed to cool. Test samples and controls were applied to the prepared panel surface(s) and allowed to stand for one minute. Thereafter the panels were wiped with a hand towel and allowed to dry. Soil removal was observed qualitatively and a rating was applied as follows according to the Table below:

| Cleaning Scale | |
|---|---|
| 0 | No soil removal |
| 1 | 0-24% soil removal |
| 2 | 25-49% soil removal |
| 3 | 50-74% soil removal |
| 4 | 75-99% soil removal |
| 5 | 100% soil removal |

EXAMPLE I

Two ready-to-use formulations were prepared differing only in the order of addition of the ingredients. The Table below provides the formulation:

| Percent by Weight | Component |
|---|---|
| 50.0862 | Water |
| 0.750 | Polyacrylic Acid (Custopoly GL) |
| 37.7855 | Water |
| 1.400 | Tetrasodium glutamate diacetate (Dissolvine GL-47-S), 47% |
| 1.420 | Sodium Hydroxide (50%) |
| 0.450 | Ethoxylated alcohol |
| 0.750 | Sodium Lauro Amphoacetate (Miranol HMA) |
| 0.250 | Alkyl Sulfate (32%) (Polystep B-29) |
| 0.440 | Monoethanolamine |
| 0.6350 | Citric Acid (50%) |
| 0.560 | Sodium Xylene Sulfonate (40%) |
| 0.500 | Potassium Silicate solution 30% (Kasil 1) |
| 2.500 | Dipropylene glycol n-butyl ether |
| 2.500 | Benzyl Alcohol |

In preparing Composition A, the polyacrylic acid (thickener) was added to water until the thickener was hydrated resulting in a dispersion. The dispersion was then neutralized with monoethanolamine. The remaining ingredients were added to the neutralized dispersion resulting in Composition A.

In preparing Composition B, the polyacrylic acid (thickener) was again added to water until the thickener was hydrated resulting in a dispersion. Instead of neutralizing the dispersion with monoethanolamine, the chelant, Dissolvine GL-47S (tetrasodium glutamate diacetate) was used. The remaining ingredients were added to the neutralized dispersion resulting in Composition B.

In preparing Composition C, the polyacrylic acid (thickener) was again added to water until the thickener was hydrated resulting in a dispersion. Instead of neutralizing the dispersion with monoethanolamine or tetrasodium glutamate diacetate, sodium hydroxide was used. The remaining ingredients were added to the neutralized dispersion resulting in Composition C.

Compositions A and C resulted in thin compositions having a viscosity of about 100 cPs and gave a vertical cling about 1.7 times better than the a commercially available control (0.31 cm/sec vs. 0.19 cm/sec travel time) but both Compositions A and C had a lot of residual product that was very thick adhered to the mix tank walls. Dawn® Power Dissolver available from Procter and Gamble located in Cincinnati, Ohio was used as the control. However, neutralizing the thickener using the chelant (Dissolvine GL-47-S) to prepare Composition B resulted in a more homogenous mix with minimal product retained on the mix tank walls. It was surprising to learn that this change in mix order resulted in a Composition B having a viscosity of 400-700 cPs. It was even more surprising that the vertical cling was now observed to be "infinite." By infinite, it is meant that when sprayed onto the same vertical stainless steel panel from about 6 inches away the product did not travel (0.00cm/sec) and instead dried before flowing. Composition B did not travel even after several hours of clinging to the vertical surface.

EXAMPLE II

Twenty formulations were prepared according to the method of the invention (neutralization of the thickener in water dispersion using tetrasodium glutamate diacetate). The twenty formulations differed in the solvents included in the composition. Each formulation had the general composition provided in the Table below. Dawn® Power Dissolver available from Procter and Gamble located in Cincinnati, Ohio was used as the control.

| Component | % By Weight |
|---|---|
| Water | 87.7844 |
| Polyacrylic acid | 0.7500 |
| Acid Red 1 (dye) | 0.0006 |
| Tetrasodium glutamate diacetate (Dissolvine GL-47 S), 47% | 1.4000 |
| Sodium hydroxide (50%) | 1.4300 |
| Ethoxylated alcohol | 0.4500 |
| Sodium Lauro Ampho acetate (Miranol HMA) | 0.8000 |
| Alkyl sulfate (Polystep B-29) | 0.2500 |

-continued

| Component | % By Weight |
|---|---|
| Monoethanolamine (99%) | 0.4400 |
| Citric Acid (50%) | 0.6350 |
| Sodium xylene sulfonate (40%) | 0.5600 |
| Potassium silicate, 30% (Kasil) | 0.5000 |
| Solvent - specifics provided in table below for each formulation | 5.0000 |

Formulations 1-20 were prepared using the base ingredients provided in the table above but including the solvents provided in the table below. Unless a precipitate formed (denoted as "ppt" in the table below) each formulation was measured for cleaning performance, phase stability, and vertical cling time. N/A in the table below stands for "not applicable."

| Formulation | Butyl Carbitol | Tripropylene glycol methyl ether (TPM) | Dipropylene glycol n-butyl ether | Benzyl alcohol | Cleaning | Stability | Cling (cm/sec) |
|---|---|---|---|---|---|---|---|
| | % by weight | | | | | | |
| 1 | 1.25 | 1.25 | 1.25 | 1.25 | 2 | Ok | 0:19 |
| 2 | 3.125 | 0.625 | 0.625 | 0.625 | 1 | Ok | 1:42 |
| 3 | — | 5.0 | — | — | N/A | Slight ppt | N/A |
| 4 | — | 2.50 | 2.50 | — | 1 | ok | 0:59 |
| 5 | — | — | — | 5.0 | N/A | ppt | N/A |
| 6 | 5.00 | — | — | — | 0 | Ok | 1:30 |
| 7 | 2.50 | — | — | 2.50 | N/A | ppt | N/A |
| 8 | 2.50 | — | 2.50 | — | 1 | Ok | 0:40 |
| 9 | 0.625 | 3.125 | 0.625 | 0.625 | 0 | Ok | 2:31 |
| 10 | — | — | — | 5.0 | N/A | ppt & phase split | N/A |
| 11 | 5.00 | — | — | — | 4 | Ok | 1:49 |
| 12 | 0.625 | 0.625 | 3.125 | 0.625 | 5 | Ok | 1:05 |
| 13 | — | 5.00 | — | — | N/A | Slight ppt | N/A |
| 14 | — | — | 2.50 | 2.50 | 5 | Ok | 2:29 |
| 15 | 2.50 | 2.50 | — | — | 2 | Ok | 1:43 |
| 16 | 2.50 | 2.50 | — | — | 2 | Ok | 1:52 |
| 17 | — | — | 5.00 | — | N/A | Ppt & phase split | N/A |
| 18 | — | — | — | 5.00 | N/A | Ppt | N/A |
| 19 | 0.625 | 0.625 | 0.625 | 3.125 | N/A | Ppt | N/A |
| 20 | — | 2.50 | — | 2.50 | 3 | Ok | 1:28 |

Formulation 14 was then tested against the control. For the cleaning test the samples were allowed to dwell on the soil for 3 minutes before the sample/soil was wiped. Both the Control and Formulation 14 performed comparable at room temperature and at 32 degrees F. which was complete removal of the sample soil. Both Formulation 14 and the Control were applied to a soiled sample at 275 degrees F. and allowed to dwell for one minute. Both samples again exhibited comparable cleaning ability removing all of the soil.

Cleaner composition of Formulation 14 was made according to the table provided above. Such cleaner composition was found to have a pH value ranging from about 10.6 to about 10.9 and a viscosity ranging from about 300 cps to about 700 cps when tested on a Brookfield Viscometer RT DV-11 using a SSA (small sample adapter) spindle number 21 at a speed of 20 rpm at a temperature of 77° F.

EXAMPLE III

Another formulation was prepared according to the method of the invention (neutralization of the thickener in water dispersion using chelant). However, formulation 21 used hydroxyethyliminodiacetic acid instead of tetrasodium glutamate diacetate. The complete Formulation 21 is shown in the Table below. As with Example II, Dawn® Power Dissolver available from Procter and Gamble located in Cincinnati, Ohio was used as the control.

Formulation 21:

| Component | % By Weight |
|---|---|
| Water | 87.100 |
| Polyacrylic acid | 0.7500 |
| Hydroxyethyliminodiacetic acid, 27% | 2.4400 |
| Sodium hydroxide (50%) | 1.1250 |
| Ethoxylated alcohol | 0.4500 |
| Sodium Lauro Ampho acetate (Miranol HMA) | 0.7500 |
| Alkyl sulfate (Polystep B-29) | 0.2500 |
| Monoethanolamine (99%) | 0.4400 |
| Citric Acid (50%) | 0.6350 |
| Sodium xylene sulfonate (40%) | 0.5600 |
| Potassium silicate, 30% (Kasil) | 0.5000 |
| Dipropylene glycol n-butyl ether | 2.5000 |
| Benzyl alcohol | 2.5000 |

Formulations 21 did not form a precipitate. Formulation 21 was measured for cleaning performance, phase stability, and vertical cling time.

| Formulation | Cleaning | Stability | Cling (cm/sec) |
|---|---|---|---|
| 21 | 5 | Ok | 0.00 |

Cleaner composition of Formulation 21 was made according to the table provided above. Such cleaner composition was found to have a pH value ranging from about 10.6 to about 11.0 (10.89 for one sample) and a viscosity ranging from about 300 cps to about 700 cps (510 for one sample) when tested on a Brookfield Viscometer RT DV-II using a SSA (small sample adapter) spindle number 21 at a speed of 20 rpm at a temperature of 77° F. Formulation 21 had a percent free alkalinity (as $Na_2O$) of 0.33% and a total free alkalinity (as $Na_2O$) of 0.86%.

A formulation is contemplated that includes a combination of the preferred chelants. That is, a formulation is envisioned that uses a combination of hydroxyethyliminodiacetic acid and tetrasodium glutamate diacetate.

Other than in the operating examples, or where otherwise indicated, all numbers expressing quantities of ingredients, reaction conditions, and so forth used in the specification and claims are to be understood as being modified in all instances by the term "about." Accordingly, unless indicated to the contrary, the numerical parameters set forth in the following specification and attached claims are approximations that may vary depending upon the desired properties sought to be obtained by an aspect of an embodiment and/or embodiments of the present invention. At the very least, and not as an attempt to limit the application of the doctrine of equivalents to the scope of the claims, each numerical parameter should be construed in light of the number of significant digits and ordinary rounding approaches.

Notwithstanding that the numerical ranges and parameters setting forth the broad scope of the invention are approximations, the numerical values set forth in the specific examples are reported as precisely as possible. Any numerical values, however, inherently contain certain errors necessarily resulting from the standard deviation found in their respective testing measurements.

While typical aspects of embodiment and/or embodiments have been set forth for the purpose of illustration, the foregoing description and the accompanying drawings should not be deemed to be a limitation on the scope of the invention. Accordingly, various modifications, adaptations, and alternatives may occur to one skilled in the art without departing from the spirit and scope of the present invention. It should be understood that all such modifications and improvements have been deleted herein for the sake of conciseness and readability but are properly within the scope of the following claims.

The invention claimed is:

1. A method of preparing a grease-removing ready-to-use cleaner comprising the steps of:

A) dispersing a thickening agent in water to create a homogenous acidic dispersion;

B) neutralizing the acidic dispersion with a chelant or a combination of chelants selected from the group consisting of tetrasodium glutamate diacetate and hydroxyethyliminodiacetic acid;

C) adding to the neutralized dispersion more components, comprising:

i) an alkalinity source comprising a mixture of an alkali metal salt and ethanolamine present in an amount sufficient to provide a free alkalinity (expressed as wt % Na2O) of less than about 1.0 wt %, based on the total weight of the cleaner composition, and a total alkalinity (expressed as wt % Na2O) of less than about 2.0 wt %, based on the total weight of the cleaner composition, ii) from about 0.1 wt % to about 3.0 wt % of one or more surfactants, iii) buffering agent to provide a pH of less than about 11.5 in the ready-to-use composition, iv) from about 3.0 wt % to about 8.0 wt % of a combination of one or more low vapor pressure solvents, and wherein the ready-to-use composition is substantially free of phosphorous, and does not travel when sprayed on a vertical surface.

2. The method according to claim 1, wherein the following components are optionally added to the composition in step C, the additional components comprising:

corrosion inhibitor, hydrotrope, dye, perfume.

3. The method of claim 1 wherein the surface is inverted.

4. The method of claim 1 wherein spraying the cleaner is accomplished using a foaming applicator.

5. The method of claim 1 wherein spraying the cleaner is accomplished via any means other than aerosol.

6. The method of claim 1 wherein the ready-to-use cleaner has a viscosity of greater than 300 cps.

7. The method of claim 1 wherein the thickening agent comprises a salt of a polycarboxylic acid.

8. The method of claim 1 wherein the one or more solvents are comprised of benzyl alcohol and dipropylene glycol n-butyl ether.

9. The method of claim 2 wherein the optional hydrotrope is comprised of sodium xylene sulfonate.

10. The method of claim 1 wherein the surfactants are selected from the group consisting of an ethoxylated alcohol, sodium lauryl sulfate, and an alkyl sulfate different from the lauryl sulfate.

11. The method of claim 1 wherein the ready-to-use composition is substantially free of volatile organic compounds.

12. A method of preparing a grease-removing ready-to-use cleaner comprising the steps of:

A) dispersing about 0.5 to about 1.5 wt % thickening agent consisting essentially of a salt of a polycarboxylic acid in about 30 wt % to about 60 wt % water to create a homogenous acidic dispersion;

B) adding from about 25 wt % to about 45 wt % water to dilute the dispersion;

B) neutralizing the acidic diluted dispersion with about 0.5 wt % to about 2.5 wt % chelant selected from the group consisting of tetrasodium glutamate diacetate and hydroxyethyliminodiacetic acid;

C) adding to the neutralized dispersion components, comprising:

i) an alkalinity source present in an amount sufficient to provide a free alkalinity (expressed as wt % $Na_2O$) of less than about 1.0 wt %, based on the total weight of the cleaner composition, and a total alkalinity (expressed as wt % $Na_2O$) of less than about 2.0 wt %, based on the total weight of the cleaner composition, the alkalinity source comprising an alkali metal salt and ethanolamine, ii) from about 0.1 wt % to about 3.0 wt % of one or more surfactants, the surfactants selected from the group consisting of alkyl sulfate, alcohol ethoxylate, and alkyl ampho acetate, iii) one or more buffering agents to provide a pH of less than about 11.5 in the ready-to-use composition, iv) from about 3.0 wt % to about 8.0 wt % of a combination of one or more solvents, the solvents selected from the group consisting of benzyl alcohol and dipropylene glycol n-butyl ether.

13. The method of claim 12 wherein the ready-to-use composition is substantially free of phosphorous.

14. The method of claim 12 wherein the ready-to-use composition is safe to handle without mask or gloves.

15. The method of claim 12 wherein the ready-to-use composition is substantially free of volatile organic compounds.

16. The method of claim 12 wherein the ready-to-use composition does not travel when sprayed on a vertical or horizontal surface.

17. The method according to claim 12, wherein the following components are optionally added to the composition in step C, the additional components comprising:

corrosion inhibitor, hydrotrope, dye, perfume.

18. The method of claim 17 wherein the optional hydrotrope is selected from the group consisting of xylenesulfonic acid, sodium salt;

toluenesulfonic acid, sodium salt; xylenesulfonic acid, ammonium salt; cumenesulfonic acid, sodium salt; cumenesulfonic acid, ammonium salt; xylenesulfonic acid, calcium salt; xylenesulfonic acid, potassium salt; and toluenesulfonic acid, potassium salt, higher glycols, polyglycol, polyoxide, glycol ether, propylene glycol ether and diproprionate.

19. The method of claim 17 wherein the ready-to-use cleaner has a viscosity of greater than 300 cps.

20. The method of claim 12, wherein the one or more buffering agents is selected from the group consisting of borate, bicarbonate, carbonate, an alkali metal salt of an inorganic acid, alkali metal salt of an organic acid, and amine salt of an organic acid.

* * * * *